US008789782B1

(12) United States Patent
Blume et al.

(10) Patent No.: US 8,789,782 B1
(45) Date of Patent: Jul. 29, 2014

(54) CAKED GRAIN BREAKING DEVICE

(76) Inventors: Colin W. Blume, Redfield, SD (US); Kenneth Blume, Redfield, SD (US)

( * ) Notice: Subject to any disclaimer, the term of this patent is extended or adjusted under 35 U.S.C. 154(b) by 267 days.

(21) Appl. No.: 13/433,813

(22) Filed: Mar. 29, 2012

(51) Int. Cl.
*B02C 17/02* (2006.01)
*B02C 7/00* (2006.01)

(52) U.S. Cl.
USPC ..... 241/95; 241/274

(58) Field of Classification Search
USPC ..... 241/95, 101.5, 101.2, 283, 274; 222/233; 414/306
See application file for complete search history.

(56) References Cited

U.S. PATENT DOCUMENTS 3,451,566 A 6/1969 Hanson
3,638,331 A 2/1972 Steffen
4,313,706 A 2/1982 Danford
4,314,675 A 2/1982 Grossman
5,074,478 A * 12/1991 Fujiwara et al. ..... 241/60
5,975,447 A 11/1999 Brusseau
6,065,650 A 5/2000 Horton et al.
7,070,133 B1 * 7/2006 Harlow ..... 241/30
2010/0254790 A1 10/2010 Tkachyk
2010/0287787 A1 11/2010 Shelton et al.

* cited by examiner

*Primary Examiner* — Faye Francis

(57) ABSTRACT

A caked grain breaking device is provided for facilitating free flow of grain from a bin by utilizing gravity to break up caked grain prior to flowing through a bottom outlet in the bin. The device includes an elongated support and a plurality of struts. Each strut has an upper end coupled to the support. Each strut further extends downwardly and outwardly from the support. The struts are arranged to form a pair of coplanar arrays of spaced the struts extending from the support. Each of a plurality of braces is coupled to and extends across an associated one of the arrays whereby the support, the struts, and the braces form a frame. A plurality of blades is coupled to the frame.

10 Claims, 4 Drawing Sheets

CAKED GRAIN BREAKING DEVICE

FIELD OF THE DISCLOSURE

The disclosure relates to caked grain breaking devices and more particularly pertains to a new caked grain breaking device for facilitating free flow of grain from a bin by utilizing gravity to break up caked grain prior to flowing through a bottom outlet in the bin.

SUMMARY OF THE DISCLOSURE

An embodiment of the disclosure meets the needs presented above by generally comprising an elongated support and a plurality of struts. Each strut has an upper end coupled to the support. Each strut further extends downwardly and outwardly from the support. The struts are arranged to form a pair of coplanar arrays of spaced the struts extending from the support. Each of a plurality of braces is coupled to and extends across an associated one of the arrays whereby the support, the struts, and the braces form a frame. A plurality of blades is coupled to the frame.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
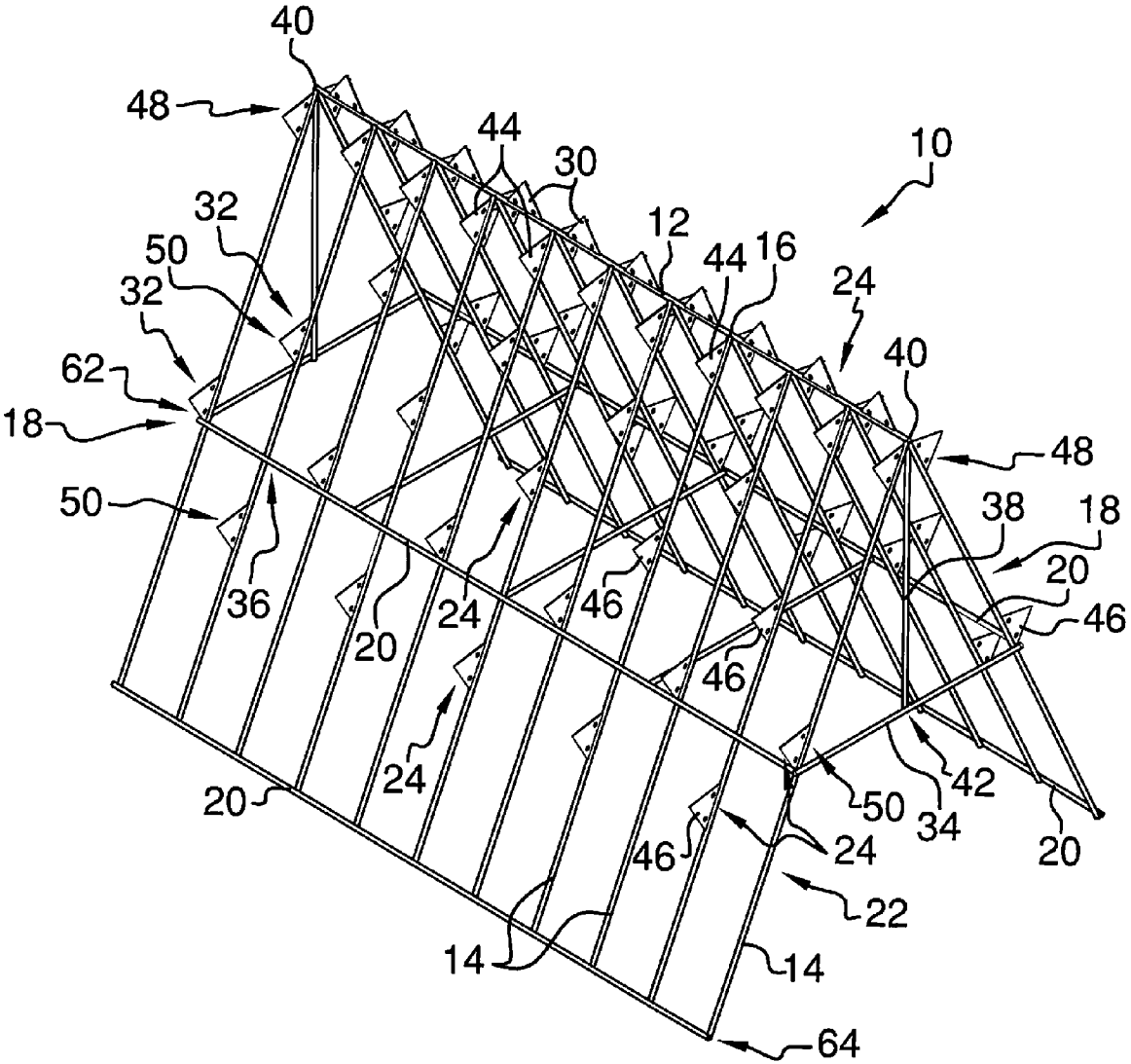
FIG. 1 is a top front side perspective view of a caked grain breaking device according to an embodiment of the disclosure.

With reference now to the drawings, and in particular to FIGS. 1 through 4 thereof, a new caked grain breaking device embodying the principles and concepts of an embodiment of the disclosure and generally designated by the reference numeral 10 will be described.

As best illustrated in FIGS. 1 through 4, the caked grain breaking device 10 generally comprises an elongated support 12 and a plurality of struts 14. Each strut 14 has an upper end 16 coupled to the support 12. Each strut 14 extends downwardly and outwardly from the support 12. The struts 14 are arranged to form a pair of coplanar arrays 18 of parallel spaced struts 14 extending from the support 12. A plurality of elongated braces 20 are provided. Each brace 20 is coupled to and extends across an associated one of the arrays 18. The braces 20 may extend transversely across the array 18 at a midpoint 62 along a length of each array 18 and along a bottom edge 64 of each array 18. The support 12, the struts 14, and the braces 20 form a frame 22 having a generally triangular lengthwise cross-sectional shape.

Figure 2:
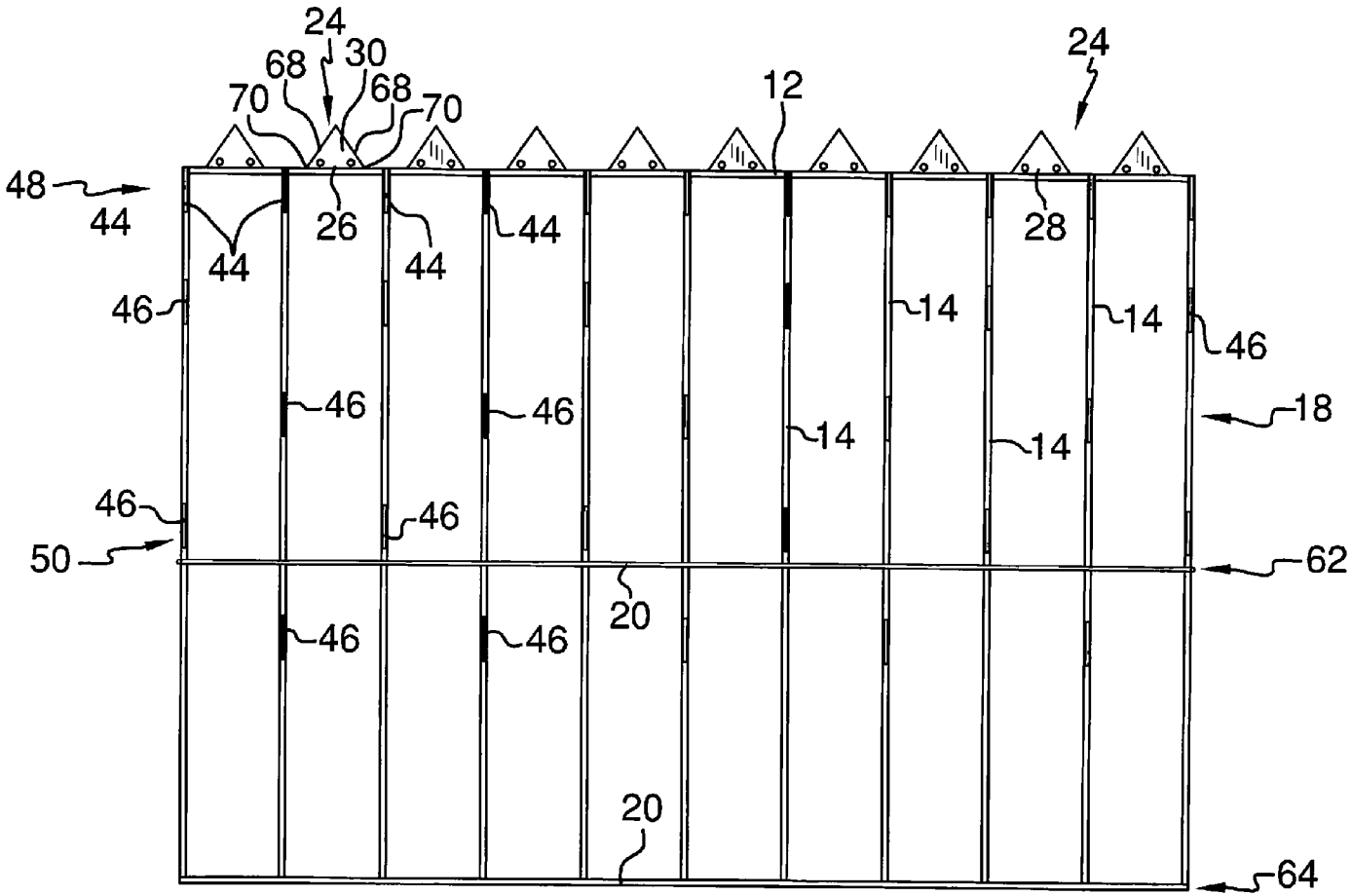
FIG. 2 is a front view of an embodiment of the disclosure.
Figure 3:
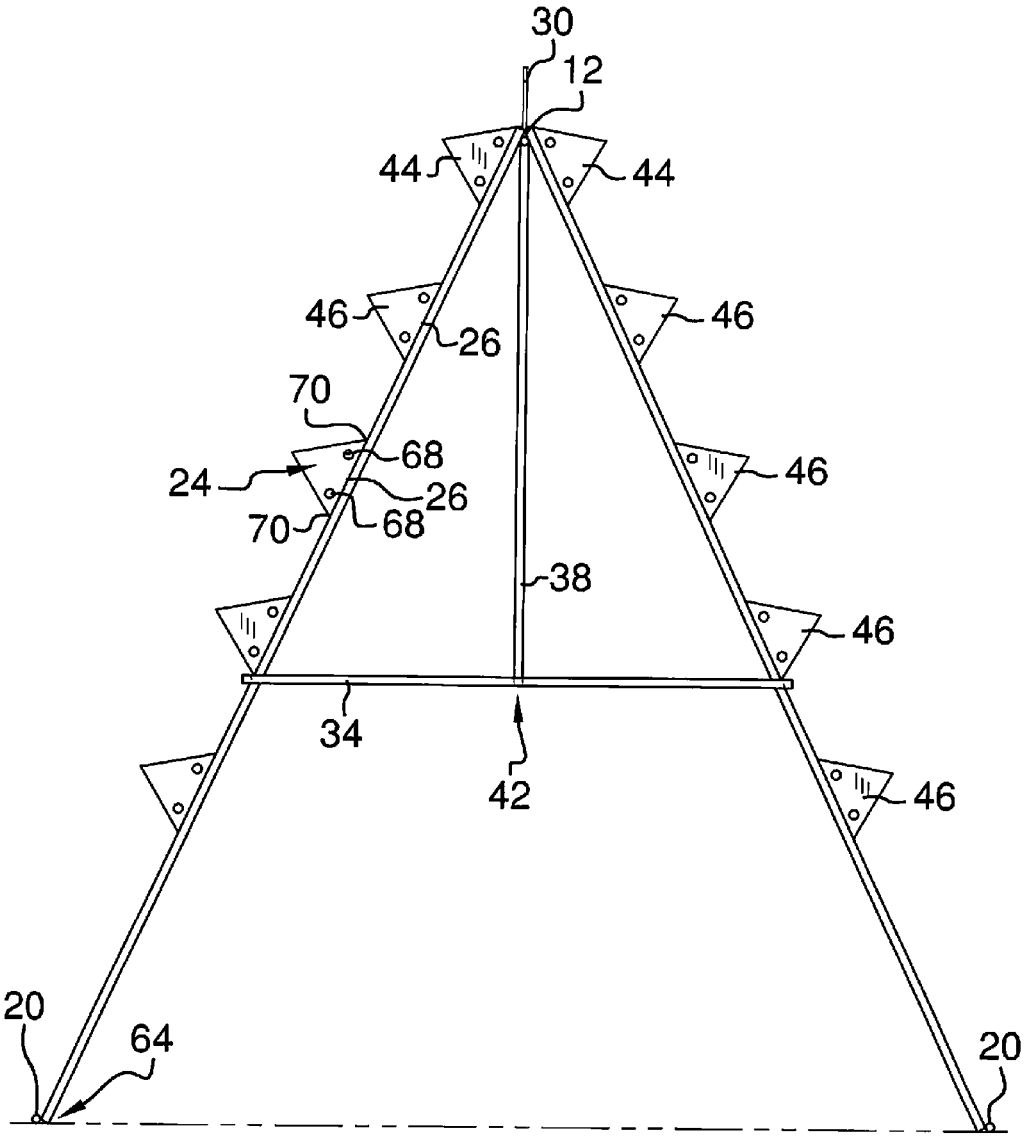
FIG. 3 is a side view of an embodiment of the disclosure.
Figure 4:
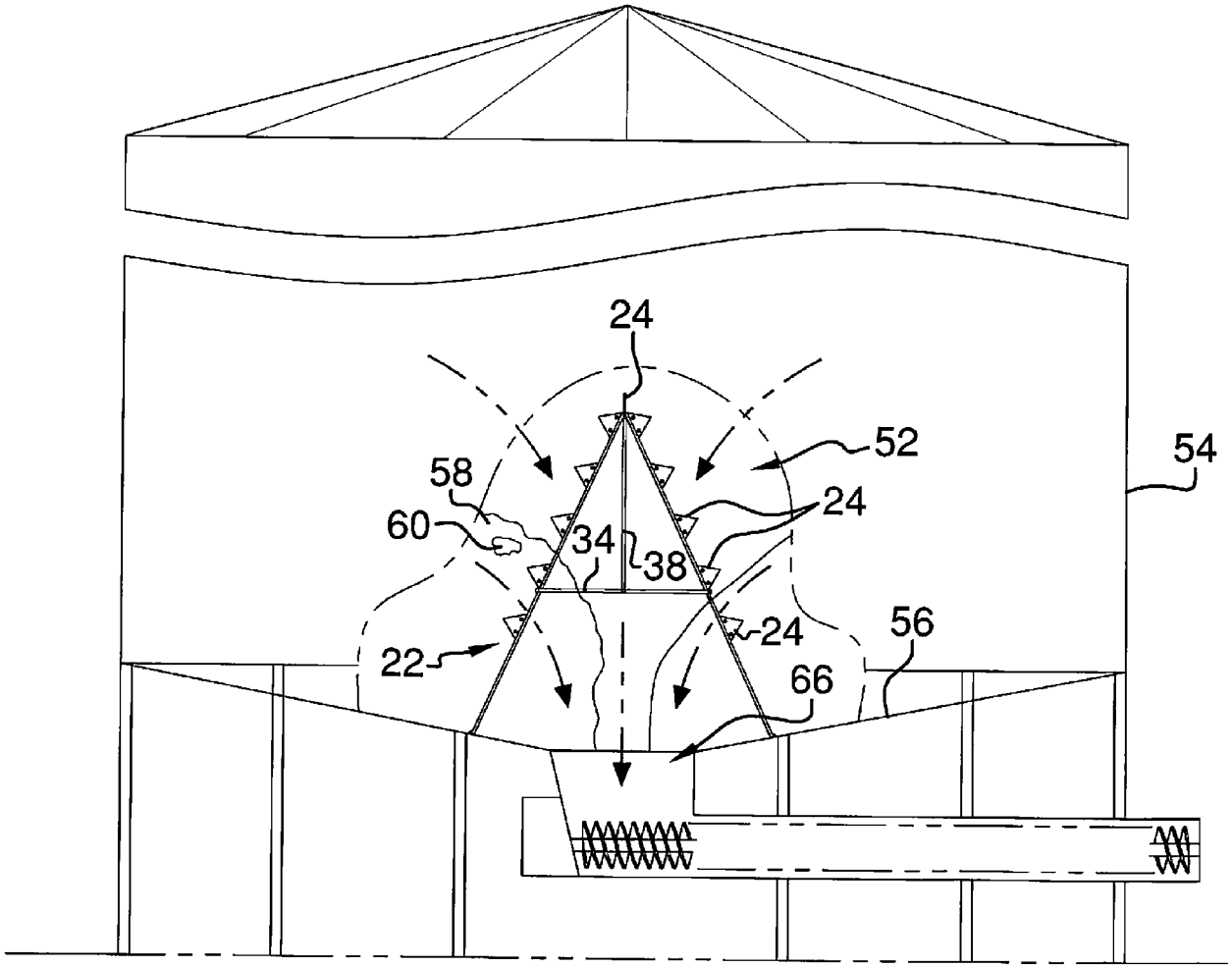
FIG. 4 is a side view of an embodiment of the disclosure in use.

A plurality of triangular blades 24 is coupled to the frame 22. Each blade 24 has a base side 26 coupled to the frame 22. The blades 24 may also be trapezoidal having a long base 28 coupled to the frame 22, an example of which is shown in FIG. 2. The plurality of blades 24 includes a plurality of top blades 30. Each top blade 30 is coupled to the support 12. The plurality of blades 24 further includes a plurality of side blades 32. Each side blade 32 is coupled to an associated one of the struts 14. Each blade 24 may have a pair of spaced holes 68 positioned proximate opposite ends 70 of the base side 26.

A plurality of the side blades 32 may be arranged to form a plurality of upper blades 44 and a plurality of lower blades 46. The upper blades 44 are arranged into a pair of top rows 48. Each top row 48 is positioned adjacent to the support 12. The lower blades 46 are arranged into a plurality of lower rows 50. The lower blades 46 forming the lower rows 50 are coupled to alternate struts 14 of the arrays 18. There may be multiple lower rows 50 and adjacently positioned lower rows 50 may be staggered relative to each other such that they are coupled to adjacently positioned struts 14.

A plurality of cross bars 34 is coupled to and extends between the arrays 18. The cross bars 34 may be arranged to extend between mid-points 36 of alternate aligned pairs of the struts 14. A pair of end bars 38 may be provided for further structural support. Each end bar 38 extends between an associated end 40 of the support 12 and an associated one of the cross bars 34. Each end bar 38 may be perpendicularly oriented relative to the cross bar 34 and couple to the cross bar 34 at a midpoint 42 of the cross bar 34.

In use, the device 10 is positioned in an interior space 52 of a grain bin 54. The frame 22 is positioned over an outlet 66 in a bottom 56 of the grain bin 54. Gravity draws grain 58 through the frame 22 wherein the frame 22 and the blades 24 break up caked grain 60 to facilitate flow of the grain 58 through the outlet 66.

A length of each strut 14 may be between 80 centimeters and 120 centimeters. A length of each end bar may be between 42 centimeters and 58 centimeters. Each cross bar 34 may have a length between 39 centimeters and 53 centimeters.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A caked grain breaking device comprising:

an elongated support;

a plurality of struts, each strut having an upper end coupled to said support, each strut extending downwardly and outwardly from said support, said struts being arranged to form a pair of coplanar arrays of spaced said struts extending from said support;

a plurality of elongated braces, each said brace being coupled to and extending across an associated one of said arrays whereby said support, said struts, and said braces form a frame; and a plurality of blades coupled to said frame.

2. The device of claim 1, further including a plurality of cross bars coupled to and extending between said arrays.

3. The device of claim 2, further including a pair of end bars, each end bar extending between an associated end of said support and an associated one of said cross bars.

4. The device of claim 1, further including each said blade being triangular.

5. The device of claim 4, further including each said blade having a base side coupled to said frame.

6. The device of claim 1, further including said plurality of blades including a plurality of top blades, each top blade being coupled to said support.

7. The device of claim 1, further including said plurality of blades including a plurality of side blades, each side blade being coupled to an associated one of said struts.

8. The device of claim 7, further including a plurality of said side blades being arranged to form a plurality of upper blades and a plurality of lower blades, said upper blades being arranged into a pair of top rows, each top row being positioned adjacent to said support.

9. The device of claim 8, further including said lower blades being arranged into a plurality of lower rows, said blades forming said lower rows being coupled to each alternate strut of said arrays.

10. A caked grain breaking device comprising:

an elongated support;

a plurality of struts, each strut having an upper end coupled to said support, each strut extending downwardly and outwardly from said support, said struts being arranged to form a pair of coplanar arrays of spaced said struts extending from said support;

a plurality of elongated braces, each said brace being coupled to and extending across an associated one of said arrays whereby said support, said struts, and said braces form a frame;

a plurality of triangular blades coupled to said frame, each said blade having a base side coupled to said frame, said plurality of blades including a plurality of top blades, each top blade being coupled to said support, said plurality of blades including a plurality of side blades, each side blade being coupled to an associated one of said struts;

a plurality of cross bars coupled to and extending between said arrays;

a pair of end bars, each end bar extending between an associated end of said support and an associated one of said cross bars; and a plurality of said side blades being arranged to form a plurality of upper blades and a plurality of lower blades, said upper blades being arranged into a pair of top rows, each top row being positioned adjacent to said support, said lower blades being arranged into a plurality of lower rows, said blades forming said lower rows being coupled to each alternate strut of said arrays.

* * * * *